United States Patent [19]

Wootton et al.

[11] 4,401,868

[45] Aug. 30, 1983

[54] VACUUM INTERRUPTER WITH A SPACIALLY MODULATED AXIAL MAGNETIC FIELD CONTACT

[75] Inventors: Roy E. Wootton, Murrysville; Roy E. Voshall, Monroeville, both of Pa.

[73] Assignee: Westinghouse Electric Corp., Pittsburgh, Pa.

[21] Appl. No.: 278,517

[22] Filed: Jun. 29, 1981

[51] Int. Cl.[3] ..... H01H 33/66

[52] U.S. Cl. ..... 200/144 B

[58] Field of Search ..... 200/144 B, 144 R, 147 R, 200/275, 279

[56] References Cited

U.S. PATENT DOCUMENTS

| | | | |
|---|---|---|---|
| 3,225,167 | 12/1965 | Greenwood | 200/144 B |
| 3,777,089 | 12/1973 | Nitz | 200/144 B |
| 4,004,117 | 1/1977 | Amsler | 200/144 B |
| 4,109,123 | 8/1978 | Lipperts | 200/144 B |
| 4,117,288 | 9/1978 | Gorman et al. | 200/144 R |
| 4,196,327 | 4/1980 | Kurosawa et al. | 200/144 B |
| 4,260,864 | 4/1981 | Wayland et al. | 200/144 B |
| 4,306,128 | 12/1981 | Innami et al. | 200/144 B |
| 4,334,133 | 6/1982 | Gebel et al. | 200/279 |
| 4,336,430 | 6/1982 | Kurosawa et al. | 200/144 B |

*Primary Examiner*—J. R. Scott

*Attorney, Agent, or Firm*—W. G. Sutcliff

[57] ABSTRACT

A vacuum circuit interrupter including axial magnetic field generating means, and arc contact structure comprising means for spacially modulating the axial magnetic field over the area of the contact. This contact structure produces adjacent regions of different magnetic field strength over the contact area, whereby a plurality of spaced apart low arc voltage, stable parallel arc current paths are established over the contact area.

5 Claims, 6 Drawing Figures

VACUUM INTERRUPTER WITH A SPACIALLY MODULATED AXIAL MAGNETIC FIELD CONTACT

BACKGROUND OF THE INVENTION

The present invention relates to vacuum-type circuit interrupters, such as are used in electric power transmission and distribution, and switchgear assemblies. In a vacuum-type interrupter, a pair of current carrying contacts are moved apart to effect circuit interruption with an arc being initially struck between the separated contacts and thereafter extinguished. Recent work has been directed towards increasing the operating voltage and current interrupting capability of such vacuum interrupters. It is well known that as the current which is to be interrupted is increased, a current value will eventually be reached at which an anode spot will form, and the rate of electrode erosion during arcing is considerably increased. Such electrode or contact erosion is a significant limiting factor in reliable long-life operation of such interrupters. Such a high current anode spot results in evolution of the contact material and severe localized heating accompanying by a large increase in the arc voltage.

It is now well known that an axial magnetic field directed along the interrupter longitudinal axis parallel to the arc current path will tend to create a diffused arc current condition, minimizing the possibility of destructive anode spot formation. Such axial field vacuum interrupters are described in representative U.S. Pat. No. 4,117,288, and U.S. Pat. No. 4,260,864. In another recent axial field vacuum interrupter teaching in U.S. Pat. No. 4,196,327, the field generating coil disposed behind the main arcing contact has a plurality of current carrying spoke members extending inward from the axial field generating coil. This structure defines current paths which define a multipole magnetic field for these electrodes. It is generally acknowledged that an axial magnetic field is effective to increase the current handling capacity of a vacuum interrupter because it divides the arc current between many cathode spots leading to a diffused arc. For high current carrying capacities, such devices have generally had large electrode diameters, and the magnetic field coils are designed to be effective over the entire electrode area. For devices in which a coil member is disposed within the interrupter envelope, the magnetic field applied in the axial direction varies with the radial distance from the axis of the device, so that a preferred radial position along the arc contact exists at which the arc voltage will be a minimum, and currents at other radial distance from the axial will tend to be extinguished. This had led to the provision of a raised annular ring arcing surface on large diameter arc contacts with the arcing current being concentrated in this annular raised portion leading to relatively inefficient use of the electrode area.

It is generally desired in providing a high current capacity vacuum interrupter contact that the arc current energy be distributed over as large a portion of the contact area as possible to minimize anode spot formation.

SUMMARY OF THE INVENTION

An improved vacuum interrupter arc contact is provided for use with an axial field vacuum interrupter device to provide a diffused arc current contact structure. At least one of the arc contacts of this device comprise means for spacially modulating the applied axial magnetic field over the area of the contact to produce adjacent regions of differing magnetic field strength. The axial magnetic field is spacially modulated over the contact area to produce a stable diffused arc current over the entire contact area with a low arc voltage. The means for spacially modulating the applied axial magnetic field may comprise arc contact portions having relative different magnetic permeability values, or by the provision of a plurality of rings or loops of high electrical conductivity material spaced apart over the arc contact area.

DESCRIPTION OF THE PREFERRED EMBODIMENT

Figure 1:
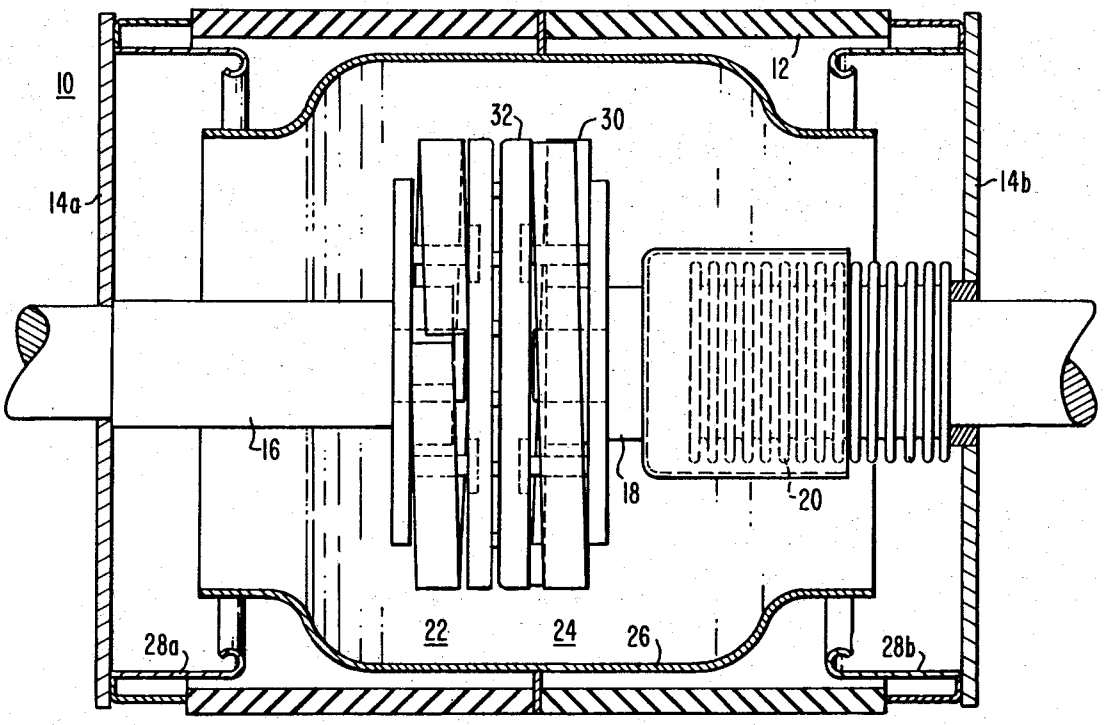
FIG. 1 is an elevational view partly in section of an axial field vacuum interrupter device of the present invention.

The present invention can be thus understood by reference to the embodiments seen in the figures. In FIG. 1 the vacuum interrupter 10 is seen in an elevational view partly in section. Interrupter 10 comprises a generally cylindrical insulating envelope 12 to which are sealed opposed end plates 14*a*, 14*b*. A fixed conductive lead 16 passes through end plate 14*a* and is sealed thereto. A movable conductive lead-in 18 is sealed through end plate 14*b* via bellow seal means 20. Respective conductive lead-ins 16 and 18 support arc contact assemblies 22 and 24. Generally cylindrical arc shield 26 is supported from the envelope 12 about the arc contacts. Respective end shield members 28*a* and 28*b* extend from the end plates and overlap the central generally cylindrical arc shield 26 to prevent deposition of conductive arc contact material on the insulating envelope 12.

Figure 3:
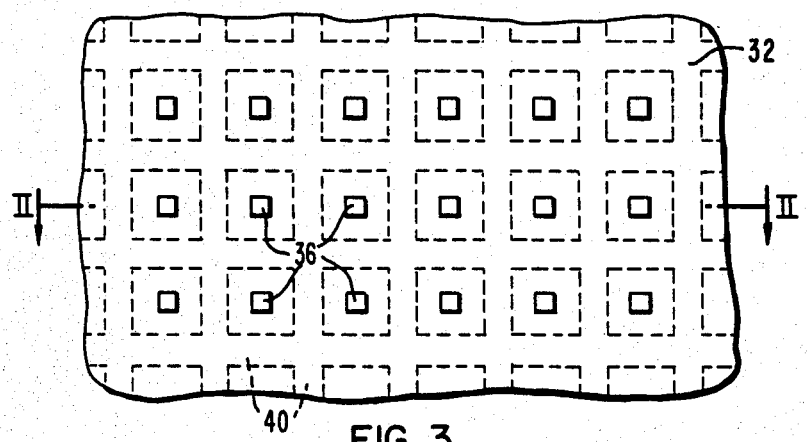
FIG. 3 is a view along the line III—III of FIG. 2 looking toward the arc contact seen in FIG. 2.

In the embodiment seen in FIG. 1, each of the arc contact members 22 and 24 includes an axial field generating coil means 30 extending between the back surface of a generally circular arcing member 32. The structure of the axial field generating coil means 30 is more fully described in aforementioned U.S. Pat. No. 4,260,864. The generally circular disk-like arc contact member 32 is seen in greater detail in FIGS. 2 and 3 wherein the arc contact 32 is seen as comprising a low magnetic permeability material arcing portion 34. The arcing portion 34 includes a plurality of small area raised surface portions 36 generally symmetrically spaced over the arcing portion 34 surface area. These raised surface portions 36 will provide a plurality of arc current contact points. The arc contact 32 includes, on the arcing portion back surface 38, a grid or lattice 40 of high magnetic permeability material. This high magnetic permeability grid 40 may be brazed to the back surface 38 of the arc contact or laid down by selective deposition of material. FIG. 3 is a view looking toward the raised surface portions 36 and of the arc contact 32 and illustrates the location of the raised surface portions 36 and, in dotted line form, the areas of low magnetic permeability which are spaced across the contact surface area and are surrounded by the grid or lattice 40 of high permeability contact areas. The effect of the high permeability grid separating the low permeability portions of the contact is to spacially modulate the axial magnetic field which is generated in the gap between the contacts during arcing. The average magnetic field strength under the inserts of high permeability material, i.e. where the magnetic permeability $\mu$ is greater than 1, is higher than the field strength in the regions of low permeability between the grid 40. The arc voltage which will be present will be lower in these low magnetic field regions, and therefore, the current will tend to be stable in these low magnetic field regions. The current will tend to be lower in the surrounding high magnetic field regions aligned with the high permeability grid 40. Thus, the arc current will tend to flow in many parallel and evenly distributed paths primarily concentrated on the raised surface portions 36. There will be a generally even distribution of energy which will be dissipated readily over the entire contact area. The raised surface portions 36 are not essential to operation of the spacial modulation of the axial magnetic field, but do serve to encourage initiation of the arc current at the lower magnetic field regions. It should be pointed out that it is not significant whether the high permeability grid portions of the contact are saturated magnetically in carrying out the modulation of the axial magnetic field.

Figure 2:
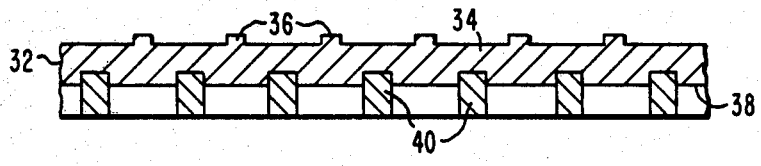
FIG. 2 is a side elevational view of the arc contact portion of the interrupter seen in FIG. 1.

In the embodiment described in FIGS. 1 through 3 both of the arc contacts include means for spacially modulating the axial magnetic field but such means need only be incorporated in one of the arc contacts and, in that case, it would be desirable that it be on the fixed contact to minimize the mass of the movable contact.

Figure 4:
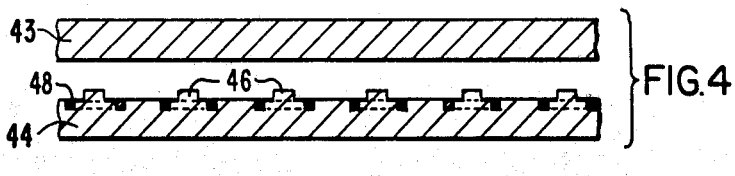
FIG. 4 is a representation of yet another embodiment of the arc structure for the present invention.
Figure 5:
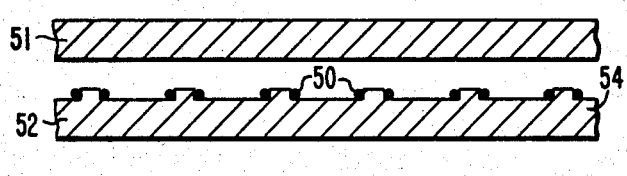
FIG. 5 is yet another schematic representation of an arc contact structure for the present invention.

In another embodiment of the present invention represented in FIGS. 4 and 5, a generally disk-shaped arc contact 44 has a plurality of raised contact portions 46 disposed over the contact surface area. The opposed disc contact 43 is spaced from contact 44. The disc-shaped arc contact 44 is formed of a low magnetic permeability material. A circular ring 48 or short-circuited loop of high conductivity material is provided about each of the raised surface portions 46 of the arc contact 44. In the embodiment in FIG. 4, the high electrical conductivity rings 48 are embedded in the low permeability disc contact 44. In the embodiment seen in FIG. 5, the high permeability rings or loops 50 are affixed to the surface of disk-like arc contact 52 about the raised surface portions 54. The opposed disc contact 51 is spaced from the contact 52. The provision of the high conductivity rings 50 or loops will result in eddy currents being produced in the high conductivity rings or loops and result in spacial modulation of the axial magnetic field with low permeability contact regions being surrounded by high magnetic field regions with the same result as for the earlier embodiment, i.e. with diffuse stable arc current forming on the raised surface areas with low arc voltages.

Figure 6:
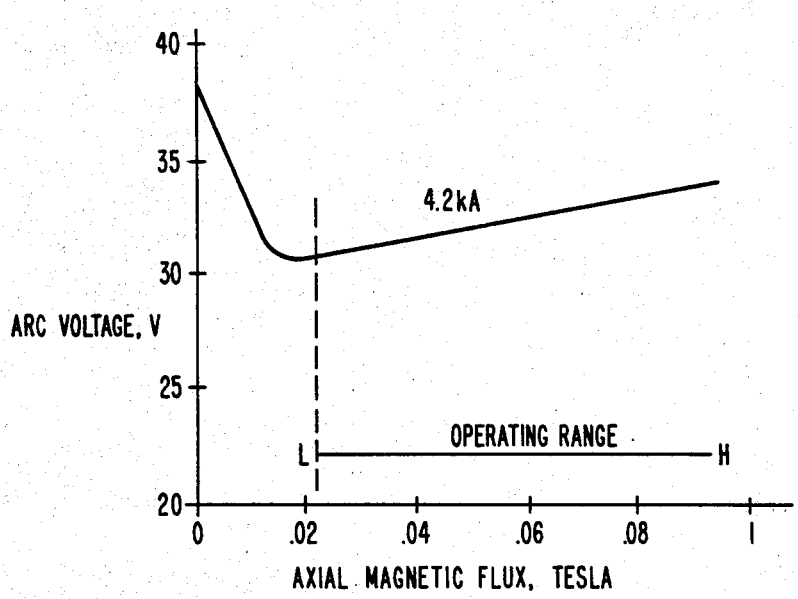
FIG. 6 is a plot of arc voltage in volts against axial magnetic field in Webers/$m^2$ for a given arc current.

The voltage versus current characteristic of a conventional vacuum interrupter is well known, with the arc voltage being relatively constant until, with increasing current, a stepped increase in the arc voltage occurs which corresponds to damaging anode spot formation. In FIG. 6, the effect of applying an axial magnetic field parallel to the arc current direction is seen, with the arc voltage being maintained relatively constant with increasing current, which is indicative of a diffuse arc condition. The axial field generating coil is in series with the arc current and the generated magnetic flux is proportional thereto, so the axial magnetic flux is plotted along the same axis as the arc current.

FIG. 6 is a plot of arc voltage (across separated arcing contacts) against axial magnetic flux for an interrupter carrying 4.2 kiloamps arc current. The curve illustrates that over an axial magnetic flux range, the arc voltage can be maintained at a relatively low value which corresponds to a diffuse arc current without damaging localized heating of the contacts. For this test example, the axial magnetic flux required started at about 0.02 webers per square meter. The magnetic permeability of this test device was not varied over its areas as suggested per the present invention, but this curve gives a frame of reference for the requisite axial magnetic flux. In devices per the present invention with a contact structure of varying permeability, the necessary axial field strength can be lower than otherwise required to maintain a diffuse arc condition. It should be understood that for higher arc currents the arc voltage versus current curve would have the same approximate shape as per FIG. 6 with somewhat higher arc voltage levels, and a higher axial magnetic flux is required to maintain the diffuse arc condition with relatively stable arc voltage value.

What we claim is:

1. An improved vacuum circuit interrupter comprising a hermetically sealed, highly evacuated envelope with conductive leads sealed through the envelope, arc contacts disposed within the envelope at internal ends of the conductive leads, with at least one of the arc contacts being movable into closed circuit mating contact with the other arc contact and to open circuit spaced apart relationship, and including means for generating an axial magnetic field between the spaced apart arc contacts directed parallel to the longitudinal axis of the envelope and the arc path between the contacts, the improvement wherein at least one of the arc contacts comprise means for spacially modulating the applied axial magnetic field over the area of the contact to produce adjacent regions of differing magnetic field strength whereby a plurality of spaced apart low arc voltage and stable parallel arc current path areas are provided over the contact area.

2. The improved circuit interrupter set forth in claim 1, wherein adjacent arc contact portions have relatively different magnetic permeability values to serve as the means for spacially modulating the applied magnetic field.

3. The improved circuit interrupter set forth in claim 1, wherein a grid of high magnetic permeability material is disposed on the back surface of the one arc contact to provide the means for spacially modulating the axial magnetic field.

4. The improved circuit interrupter set forth in claim 2, wherein the arcing surface of the one arc contact has a plurality of raised surface arcing areas spaced over the arcing surface with the raised surface areas coincident with the relatively lower magnetic permeability regions of the contact.

5. The improved circuit interrupter set forth in claim 1, wherein a plurality of rings or loops of high electrical conductivity material are spaced over one arc contact area to serve as the means for spacially modulating the applied axial magnetic field, with eddy currents induced in such high conductivity loops producing lower magnetic field regions over the arc contact area.

* * * * *